US011587478B1

(12) United States Patent
Mcknight

(10) Patent No.: US 11,587,478 B1
(45) Date of Patent: Feb. 21, 2023

(54) WEARABLE ADVERTISEMENT DEVICE

(71) Applicant: Michael Mcknight, Charlotte, NC (US)

(72) Inventor: Michael Mcknight, Charlotte, NC (US)

( * ) Notice: Subject to any disclaimer, the term of this patent is extended or adjusted under 35 U.S.C. 154(b) by 0 days.

(21) Appl. No.: 16/953,077

(22) Filed: Nov. 19, 2020

(51) Int. Cl.

| | |
|---|---|
| ***G09F 21/02*** | (2006.01) |
| ***A43B 3/12*** | (2006.01) |
| ***A44C 5/00*** | (2006.01) |
| *G06Q 90/00* | (2006.01) |

(52) U.S. Cl.
CPC ..... *G09F 21/026* (2013.01); *A43B 3/126* (2013.01); *A44C 5/0015* (2013.01); *G06Q 90/00* (2013.01)

(58) Field of Classification Search
CPC ..... G09F 21/026; A44C 5/0015; A43B 3/126; G06Q 90/00
USPC ..... 40/664, 661.11, 661.04, 633, 662, 665
See application file for complete search history.

(56) References Cited

U.S. PATENT DOCUMENTS

| | | | | |
|---|---|---|---|---|
| 2,911,743 | A * | 11/1959 | Pokras | G09F 3/005 40/633 |
| 3,059,359 | A * | 10/1962 | Goldammer | G09F 3/005 40/633 |
| 3,965,589 | A * | 6/1976 | McDermott | G09F 3/005 40/633 |
| 5,457,440 | A * | 10/1995 | Daddono | G08B 21/02 340/8.1 |
| 5,577,395 | A * | 11/1996 | Kuykendall | G09F 3/005 63/3 |
| 7,631,449 | B2 * | 12/2009 | McDermott | G09F 3/005 40/633 |
| 2011/0209372 | A1 * | 9/2011 | Padgett | G09F 3/005 40/633 |

* cited by examiner

*Primary Examiner* — Jonathan Liu
*Assistant Examiner* — Rachel Mae Griffith
(74) *Attorney, Agent, or Firm* — Leavitt Eldredge Law Firm

(57) ABSTRACT

A wearable advertisement device includes a strap portion having a plurality of fastening apertures along the length of the strap, one or more fastener members and an advertisement plaque. The advertisement plaque may include any custom advertisement to be displayed while the device is worn by a user. The device may be worn by a user around the user's wrist or ankle or the device may serve as a strap such as a sandal strap or otherwise worn on the user's footwear.

4 Claims, 5 Drawing Sheets

WEARABLE ADVERTISEMENT DEVICE

BACKGROUND

1. Field of the Invention

The present invention relates generally to wearable accessories, and more specifically, to a wearable advertisement device for a user to wear around an ankle or wrist and configured to display an advertisement.

2. Description of Related Art

Wearable accessories are well known in the art and are effective means to allow a user self-expression. For example, FIG. 1 depicts a conventional wearable accessory 101 having a single band displaying an advertisement. During use, the band fits around a user's wrist.

One of the problems commonly associated with device 101 is the inability to change the advertisement displayed. For example, device 101 displays a single advertisement integrated into the band. The band on device 101 is also not adjustable and is limited to a single size.

Accordingly, although great strides have been made in the area of wearable accessories, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
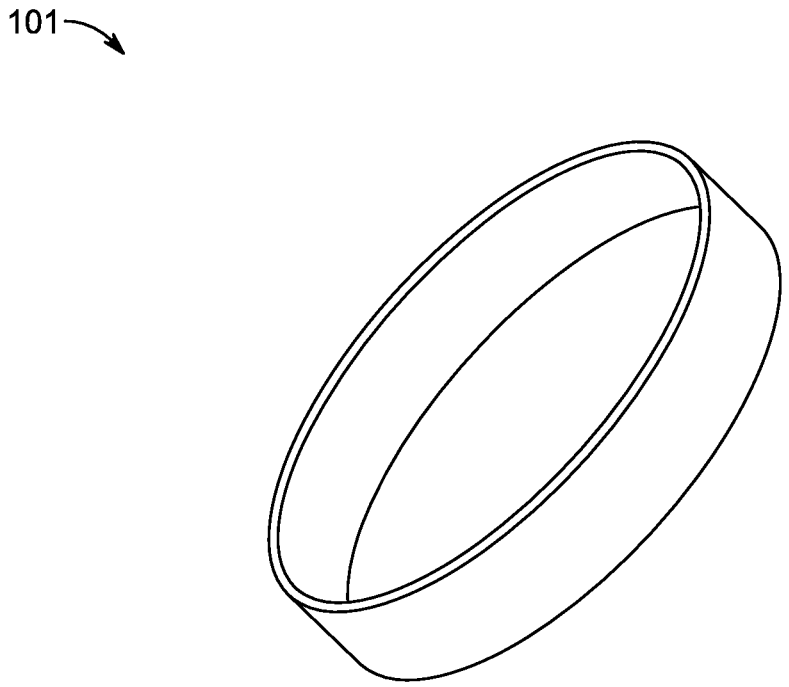
FIG. 1 (Prior Art)
FIG. 1 shows a common wearable accessory.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wearable accessories. Specifically, the wearable advertisement device has the ability to interchange different advertisements according to a user's preference. In addition, the wearable advertisement device is adjustable in size and can be worn around the wrist or ankle of the user or another location according to the user's preference. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
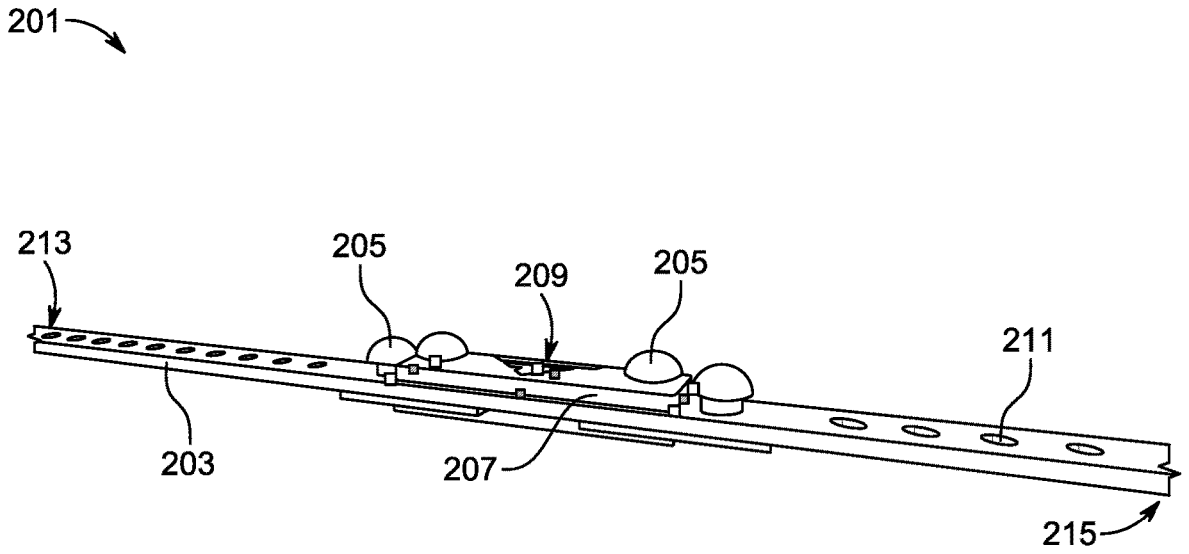
FIG. 2 shows a wearable advertisement device system in accordance with a preferred embodiment of the present application.
Figure 3:
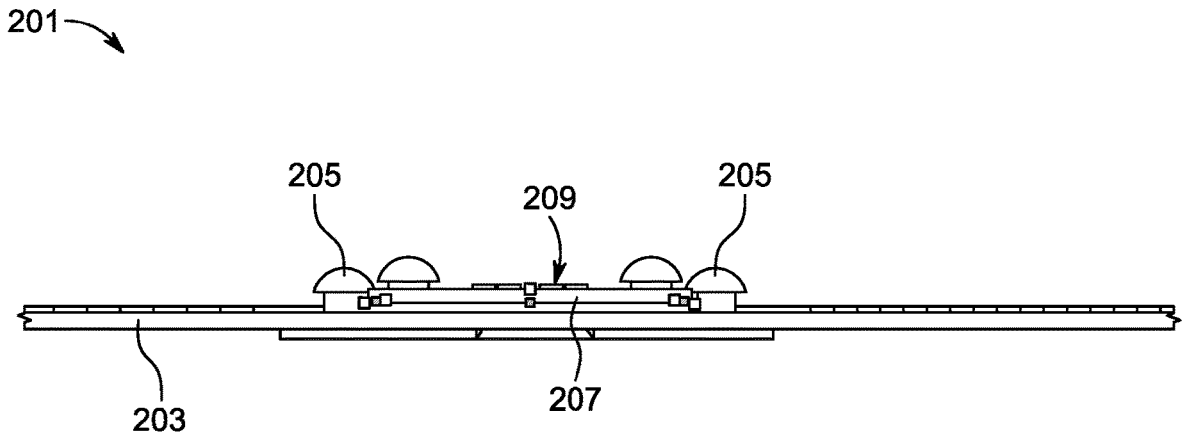
FIG. 3 shows a side view of the system of FIG. 2.
Figure 4:
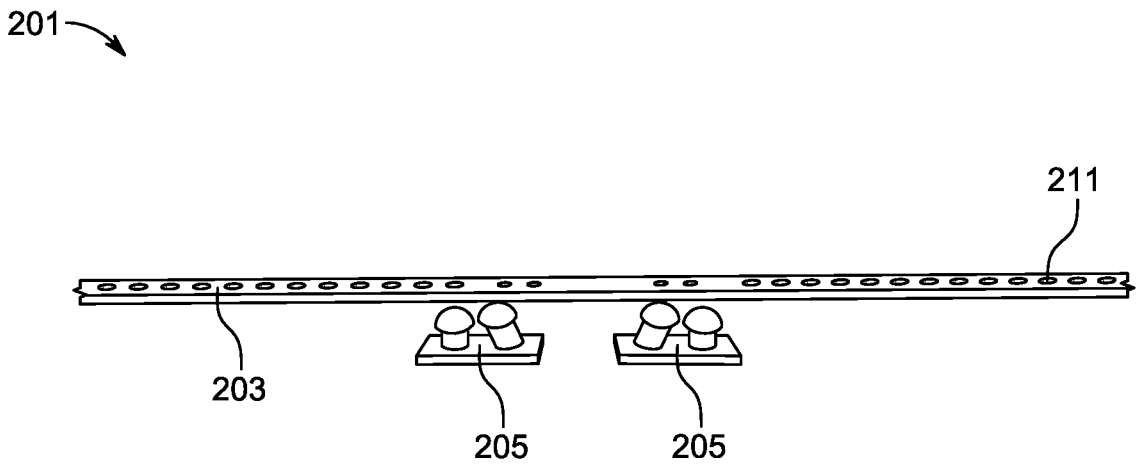
FIG. 4 shows a top isometric and deconstructed view of the system of FIG. 2.

Referring now to the drawings wherein like reference characters identify corresponding or similar elements throughout the several views, FIG. 2 depicts a side view of a wearable advertisement device in accordance with a preferred embodiment of the present application. It will be appreciated that device 201 overcomes one or more of the above-listed problems commonly associated with conventional wearable accessories.

In the contemplated embodiment, device 201 includes an elongated strap 203 having a first end 213 and a second end 215. The elongated strap 203 has a plurality of spaced fastening apertures 211 starting from each of the first end 213 and the second end 215 and continuing towards a center portion of the elongated strap 203.

Device 201 also includes a plurality of fastener members 205 attached to the center portion of the elongated strap 203; each of the fastener member 205 has two protrusions, and one of the protrusions of each of the fastener member 205 has a height greater than the other protrusion. The fastener members 205 are used for adjusting the sizing of the elongated strap 203 while worn by a user. The fastener members 205 may also be configured to hold an advertisement plaque 207. Each of the first end 213 and the second end 215 of the elongated strap 203 wrap around such that a fastening aperture 211 on each end engages with a fastener member 205 in the center portion of the elongated strap 203. The size of the device is adjustable by engaging a different fastening aperture 211 with the fastening members 205 according to the user's preference.

Figure 5:
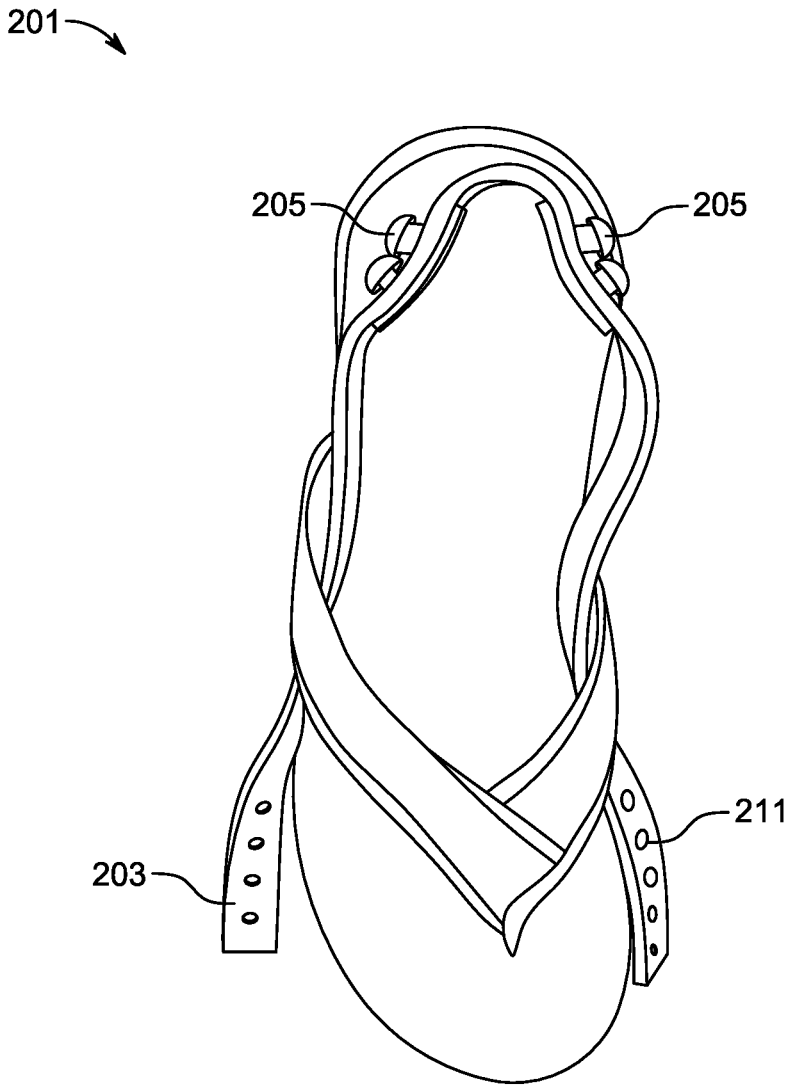
FIG. 5 shows the system of FIG. 2 used as a sandal strap in accordance with the present application.

The advertisement plaque 207 includes an advertisement 209 which may be a custom design or logo according to the user's preference. The device 201 may be worn by the user around the user's wrist or ankle. Alternatively, device 201 may be used as a sandal strap or otherwise worn by the user on the user's footwear as depicted in FIG. 5.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A wearable advertisement device, comprising:

an elongated strap and having:

a first end;

a second end;

a plurality of fastening apertures extending a length from the first end to the second end, the plurality of fastener apertures extending through a thickness of the elongated strap; and a first fastener member having a first protrusion and a second protrusion connected by a base, wherein the first protrusion has a height greater than the second protrusion;

a second fastener member being a separate entity from the first fastener member and the elongated strap, the second fastener member having a base and a first protrusion and a second protrusion, wherein the second protrusion has a height greater than the first protrusion;

the first and second fastener members are attached to the elongated strap and configured to receive at least one fastening aperture of the plurality of fastening apertures, the first fastener member and the second fastener member extending through the thickness of the elongated strap; and an advertisement plaque attached to the elongated strap via the first protrusion of the first fastener member and the second protrusion of the second fastener member and to display an advertisement, the advertisement plaque is removably attached to the elongated strap via the first fastener member and the second fastener member.

2. The wearable advertisement device of claim 1, wherein the device is configured to be worn around a user's wrist.

3. The wearable advertisement device of claim 1, wherein the device is configured to be worn around a user's ankle.

4. The wearable advertisement device of claim 1, wherein the device is configured to be worn on a user's footwear.

* * * * *